US010029467B2

(12) United States Patent
Choy et al.

(10) Patent No.: US 10,029,467 B2
(45) **Date of Patent: *Jul. 24, 2018**

(54) MOLDED PRINTHEAD

(71) Applicant: HEWLETT-PACKARD DEVELOPMENT COMPANY, L.P., Houston, TX (US)

(72) Inventors: Silam J. Choy, Corvallis, OR (US); Michael W. Cumbie, Albany, OR (US); Devin Alexander Mourey, Albany, OR (US); Chien-Hua Chen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/770,608

(22) PCT Filed: Sep. 27, 2013

(86) PCT No.: PCT/US2013/062221

§ 371 (c)(1),
(2) Date: Aug. 26, 2015

(87) PCT Pub. No.: WO2014/133590

PCT Pub. Date: Sep. 4, 2014

(65) Prior Publication Data

US 2016/0009086 A1 Jan. 14, 2016

(30) Foreign Application Priority Data

Feb. 28, 2013 (WO) ..... PCT/US2013/028216
Jun. 17, 2013 (WO) ..... PCT/US2013/046065

(51) Int. Cl.
*B41J 2/16* (2006.01)
*B41J 2/14* (2006.01)

(52) U.S. Cl.
CPC ..... *B41J 2/1637* (2013.01); *B41J 2/14* (2013.01); *B41J 2/16* (2013.01);
(Continued)

(58) Field of Classification Search
CPC ..... B41J 2/1433; B41J 2/162; B41J 2/1623; B41J 2/1637; B41J 2002/14362;
(Continued)

(56) References Cited

U.S. PATENT DOCUMENTS 4,633,274 A 12/1986 Matsuda
4,873,622 A 10/1989 Komuro et al.
(Continued)

FOREIGN PATENT DOCUMENTS

CN 1286172 A 3/2001
CN 1297815 A 6/2001
(Continued)

OTHER PUBLICATIONS

Hayes, D.J. et al.; Microjet Printing of Solder and Polymers for Multi-chip Modules and Chip-scale Packages http://citeseerx.ist.psu.edu/viewdoc/download?doi=10.1.1.88.3951&rep=rep1&type=pdf >; May 14, 1999.
(Continued)

*Primary Examiner* — Julian Huffman
*Assistant Examiner* — Michael Konczal
(74) *Attorney, Agent, or Firm* — HP Inc. Patent Department

(57) ABSTRACT

In one example, a printhead includes: a printhead die having a front face along which fluid may be dispensed from the die, the die molded into a monolithic molding having a channel therein through which fluid may pass directly to a back part of the die, the front face of the die exposed outside the molding and the back part of the die covered by the molding except at the channel; an electrical contact exposed outside
(Continued)

the molding to connect to circuitry external to the printhead; a printed circuit board molded into the molding, the printed circuit board having an exposed front face co-planar with and surrounding the exposed front face of the die and a conductor electrically connected to the contact; and an electrical connection between the die and the printed circuit board conductor fully encapsulated in the molding.

17 Claims, 11 Drawing Sheets

(52) U.S. Cl.
CPC .. *B41J 2002/14491* (2013.01); *B41J 2202/19* (2013.01); *B41J 2202/20* (2013.01)

(58) Field of Classification Search
CPC ... B41J 2/14; B41J 2/16; B41J 2202/19; B41J 2202/20; B41J 2002/14491
USPC ..... 347/50
See application file for complete search history.

(56) References Cited

U.S. PATENT DOCUMENTS

| | | | | |
|---|---|---|---|---|
| 6,145,965 | A | 11/2000 | Inada et al. | |
| 6,188,414 | B1 | 2/2001 | Wong et al. | |
| 6,190,002 | B1 * | 2/2001 | Spivey | B41J 2/14 347/50 |
| 6,250,738 | B1 | 6/2001 | Waller et al. | |
| 6,254,819 | B1 | 7/2001 | Chatterjee et al. | |
| 6,464,333 | B1 | 10/2002 | Scheffelin et al. | |
| 6,543,879 | B1 | 4/2003 | Feinn et al. | |
| 6,554,399 | B2 | 4/2003 | Wong et al. | |
| 6,560,871 | B1 | 5/2003 | Brown et al. | |
| 6,676,245 | B2 | 1/2004 | Silverbrook | |
| 6,767,089 | B2 | 7/2004 | Buswell et al. | |
| 6,962,406 | B2 | 11/2005 | Kawamura et al. | |
| 7,185,968 | B2 * | 3/2007 | Kim | B41J 2/14233 347/20 |
| 7,490,924 | B2 | 2/2009 | Haluzak et al. | |
| 7,591,535 | B2 | 9/2009 | Nystrom et al. | |
| 7,658,470 | B1 | 2/2010 | Jones et al. | |
| 7,824,013 | B2 | 11/2010 | Chung-Long et al. | |
| 7,877,875 | B2 | 2/2011 | O'Farrell et al. | |
| 8,063,318 | B2 | 11/2011 | Williams et al. | |
| 8,101,438 | B2 * | 1/2012 | McAvoy | B41J 2/155 216/27 |
| 8,197,031 | B2 | 6/2012 | Stephens et al. | |
| 8,235,500 | B2 | 8/2012 | Nystrom et al. | |
| 8,246,141 | B2 * | 8/2012 | Petruchik | B41J 2/14024 347/20 |
| 8,272,130 | B2 | 9/2012 | Miyazaki | |
| 8,287,104 | B2 | 10/2012 | Sharan et al. | |
| 8,342,652 | B2 | 1/2013 | Nystrom et al. | |
| 8,485,637 | B2 | 7/2013 | Dietl | |
| 2002/0180846 | A1 | 12/2002 | Silverbrook | |
| 2003/0186474 | A1 | 10/2003 | Haluzak | |
| 2004/0032468 | A1 | 2/2004 | Killmeier et al. | |
| 2005/0024444 | A1 | 2/2005 | Conta et al. | |
| 2008/0239002 | A1 | 10/2008 | Nystrom et al. | |
| 2008/0259125 | A1 | 10/2008 | Haluzak et al. | |
| 2008/0291243 | A1 | 11/2008 | Osaki | |
| 2008/0297564 | A1 | 12/2008 | Jeong et al. | |
| 2009/0014413 | A1 | 1/2009 | Nystrom et al. | |
| 2009/0225131 | A1 | 9/2009 | Chen et al. | |
| 2011/0019210 | A1 | 1/2011 | Chung et al. | |
| 2011/0037808 | A1 * | 2/2011 | Ciminelli | B41J 2/14072 347/50 |
| 2011/0141691 | A1 | 6/2011 | Slaton et al. | |
| 2011/0222239 | A1 | 9/2011 | Dede | |
| 2011/0292126 | A1 | 12/2011 | Nystrom et al. | |
| 2011/0298868 | A1 | 12/2011 | Fielder et al. | |
| 2012/0019593 | A1 | 1/2012 | Scheffelin et al. | |
| 2012/0124835 | A1 | 5/2012 | Okano et al. | |
| 2012/0186079 | A1 | 7/2012 | Ciminelli | |
| 2012/0210580 | A1 | 8/2012 | Dietl | |
| 2012/0212540 | A1 | 8/2012 | Dietl | |
| 2013/0194349 | A1 | 8/2013 | Ciminelli et al. | |
| 2016/0001558 | A1 * | 1/2016 | Chen | B41J 2/14 347/50 |

FOREIGN PATENT DOCUMENTS

| | | | |
|---|---|---|---|
| CN | 1314244 | | 9/2001 |
| CN | 101020389 | | 8/2007 |
| EP | 0705698 | A2 | 4/1996 |
| EP | 1095773 | | 5/2001 |
| EP | 1080907 | | 7/2001 |
| EP | 1518685 | A1 | 3/2005 |
| JP | S60-262649 | A | 12/1985 |
| JP | 2001071490 | | 3/2001 |
| JP | 2004-148827 | | 5/2004 |
| JP | 2006321222 | | 11/2006 |
| JP | 2010137460 | | 6/2010 |
| JP | 2013-501655 | A | 1/2013 |
| WO | WO-2012134480 | | 10/2012 |

OTHER PUBLICATIONS

Kumar, Aditya et al; Wafer Level Embedding Technology for 3D Wafer Level Embedded Package; Institute of Microelectronics, A*Star; 2Kinergy Ltd, TECHplace II; 2009 Electronic Components and Technology Conference.

Lee et al; A Thermal Inkjet Printhead with a Monolithically Fabricated Nozzle Plate and Self-aligned Ink Feed Hole; Journal of Microelectromechanical Systems; vol. 8, No. 3; Sep. 1999; pp. 229-236.

Lindemann, T. et al.; One Inch Thermal Bubble Jet Printhead with Laser Structured Integrated Polyimide Nozzle Plate; http://ieeexplore.ieee.org/stamp/stamp.jsp?tp=&arnumber=41.

European Patent Office, Communication pursuant to Rule 164(1) EPC for Appl. No. 13876407.1 dated Jan. 5, 2017 (7 pages).

European Patent Office, Extended European Search Report for Appl. No. 13876407.1 dated May 31, 2017 (18 pages).

Korean Intellectual Property Office, International Search Report and Written Opinion for PCT/US2013/062221 dated Dec. 19, 2013 (13 pages).

* cited by examiner

MOLDED PRINTHEAD

BACKGROUND

Conventional inkjet printheads require fluidic fan-out from microscopic ink ejection chambers to macroscopic ink supply channels.

DRAWINGS

The same part numbers designate the same or similar parts throughout the figures. The figures are not necessarily to scale. The relative size of some parts is exaggerated to more clearly illustrate the example shown.

DESCRIPTION

Conventional inkjet printheads require fluidic fan-out from microscopic ink ejection chambers to macroscopic ink supply channels. Hewlett-Packard Company has developed new, molded inkjet printheads that break the connection between the size of the die needed for the ejection chambers and the spacing needed for fluidic fan-out, enabling the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. Although this new approach has many advantages, one challenge is making robust electrical connections between the printhead dies and external wiring that withstand ink and mechanical stresses while not interfering with low cost capping and servicing.

To help meet this challenge, a new molded printhead has been developed in which, for one example configuration, the electrical connections are moved to the back of the printhead die and embedded in the molding. This configuration allows mechanically robust connections that are largely protected from exposure to ink and, because there are no electrical connections along the front face of the die, the printhead can be made flat and thus minimize protruding structures that might interfere with printhead-to-paper spacing and/or capping and servicing. In one example implementation, described in detail below, a page wide molded print bar includes multiple printheads with bond wires buried in the molding. The electrical connections are routed from the back of each printhead die through a printed circuit board embedded in the molding to enable a continuous planar surface across the front face of the print bar where the ejection orifices are exposed to dispense printing fluid.

Examples of the new printhead are not limited to page wide print bars, but may be implemented in other structures or assemblies. As used in this document, a "printhead" and a "printhead die" mean that part of an inkjet printer or other inkjet type dispenser that dispenses fluid from one or more openings, and a die "sliver" means a printhead die with a ratio of length to width of 50 or more. A printhead includes one or more printhead dies. "Printhead" and "printhead die" are not limited to printing with ink and other printing fluids but also include inkjet type dispensing of other fluids and/or for uses other than printing. The examples shown in the Figures and described herein illustrate but do not limit the invention, which is defined in the Claims following this Description.

Figure 1:
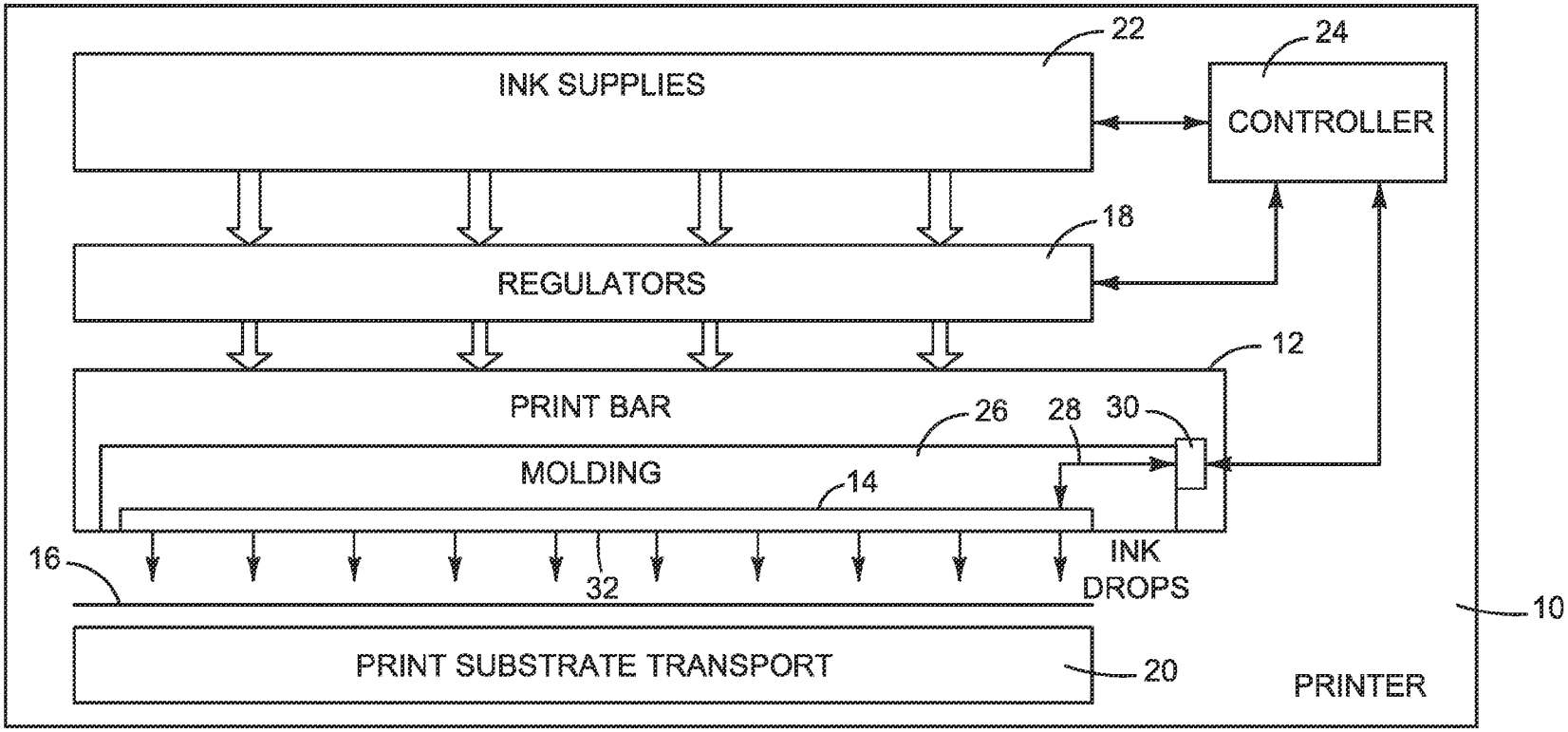
FIG. 1 is a block diagram illustrating an inkjet printer with a media wide print bar implementing one example of a new molded printhead.

FIG. 1 is a block diagram illustrating an inkjet printer 10 with a media wide print bar 12 implementing one example of a molded printhead 14. Referring to FIG. 1, printer 10 includes a print bar 12 spanning the width of a print media 16, flow regulators 18 associated with print bar 12, a media transport mechanism 20, ink or other printing fluid supplies 22, and a printer controller 24. Controller 24 represents the programming, processor(s) and associated memory(ies), and the electronic circuitry and components needed to control the operative elements of a printer 10. Print bar 12 includes an arrangement of one or more molded printheads 14 for dispensing printing fluid on to a sheet or continuous web of paper or other print media 16. Print bar 12 in FIG. 1 includes one or more printheads 14 embedded in a molding 26 spanning print media 16. The electrical connections 28 between printhead(s) 14 and the contacts 30 to external circuits are routed from the back of each printhead 14 and buried in molding 26 to allow a single uninterrupted planar surface along the front face 32 of printhead(s) 14.

Figure 2:
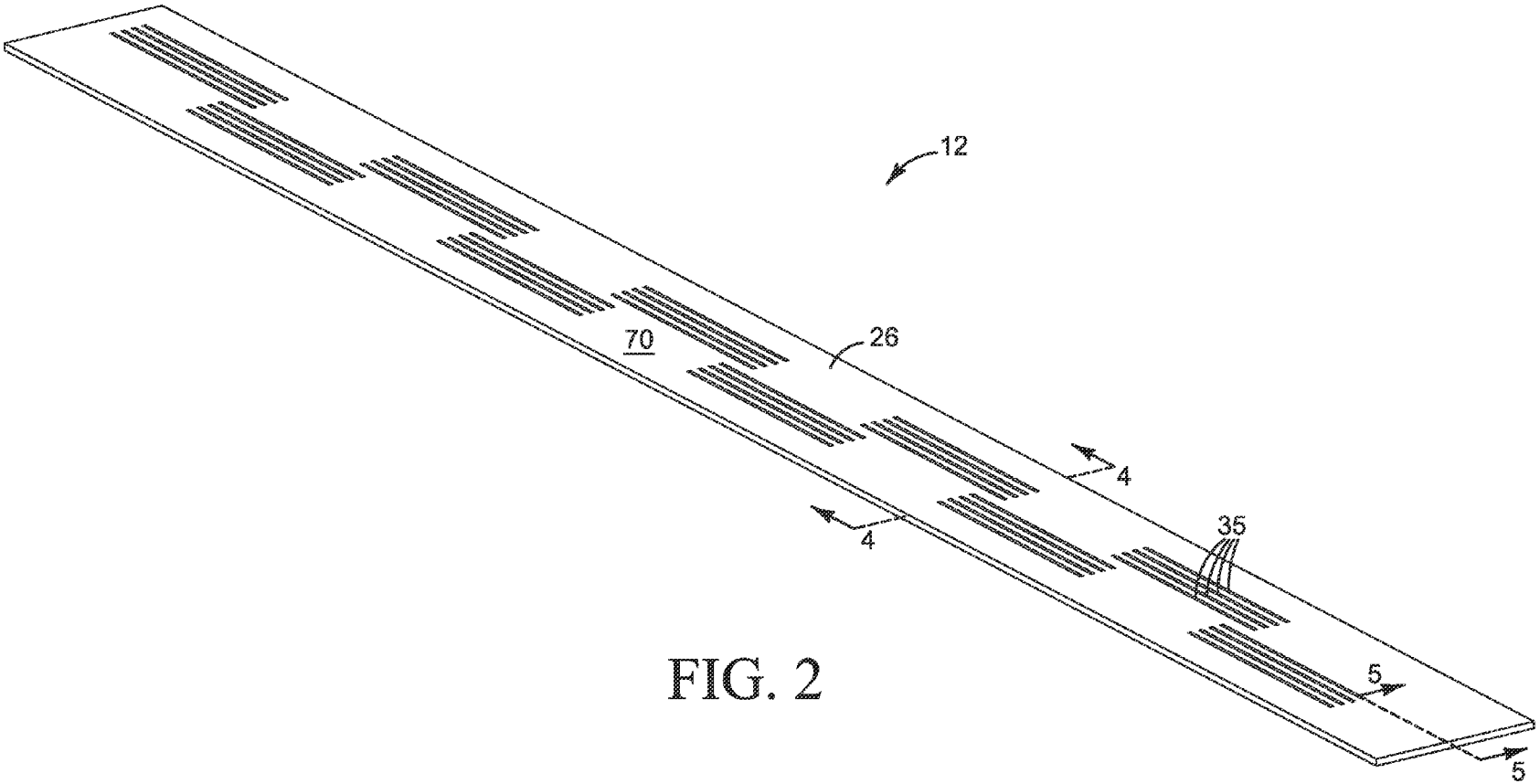
FIGS. 2 and 3 are back-side and front-side perspective views, respectively, illustrating one example of a molded print bar with multiple printheads such as might be used in the printer shown in FIG. 1.
Figure 3:
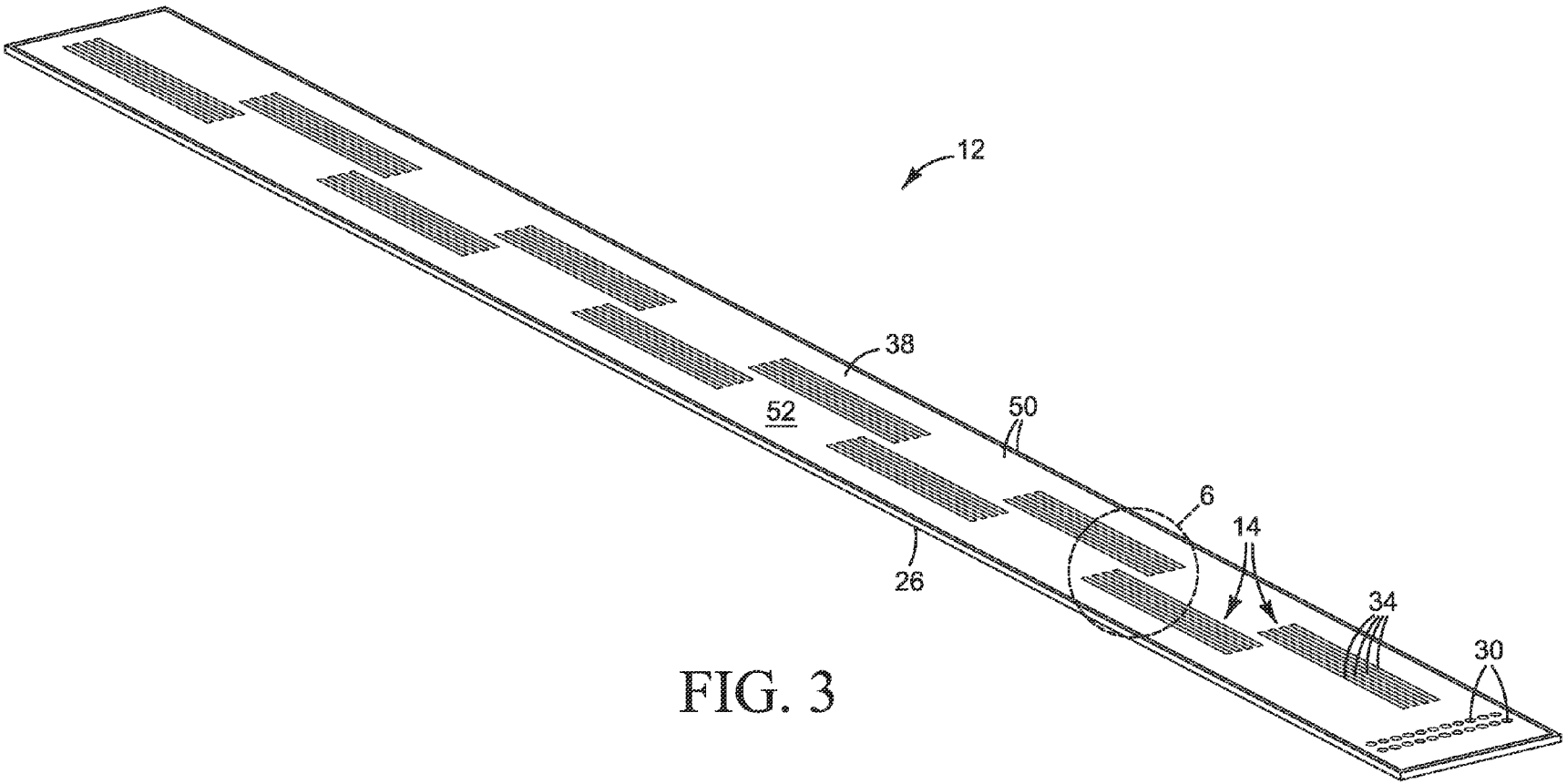
Figure 4:
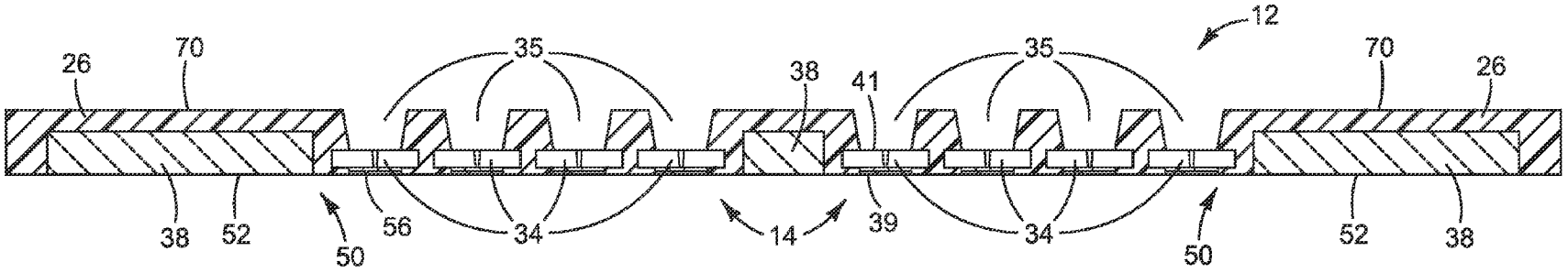
FIG. 4 is a section view taken along the line 4-4 in FIG. 2.
Figure 5:
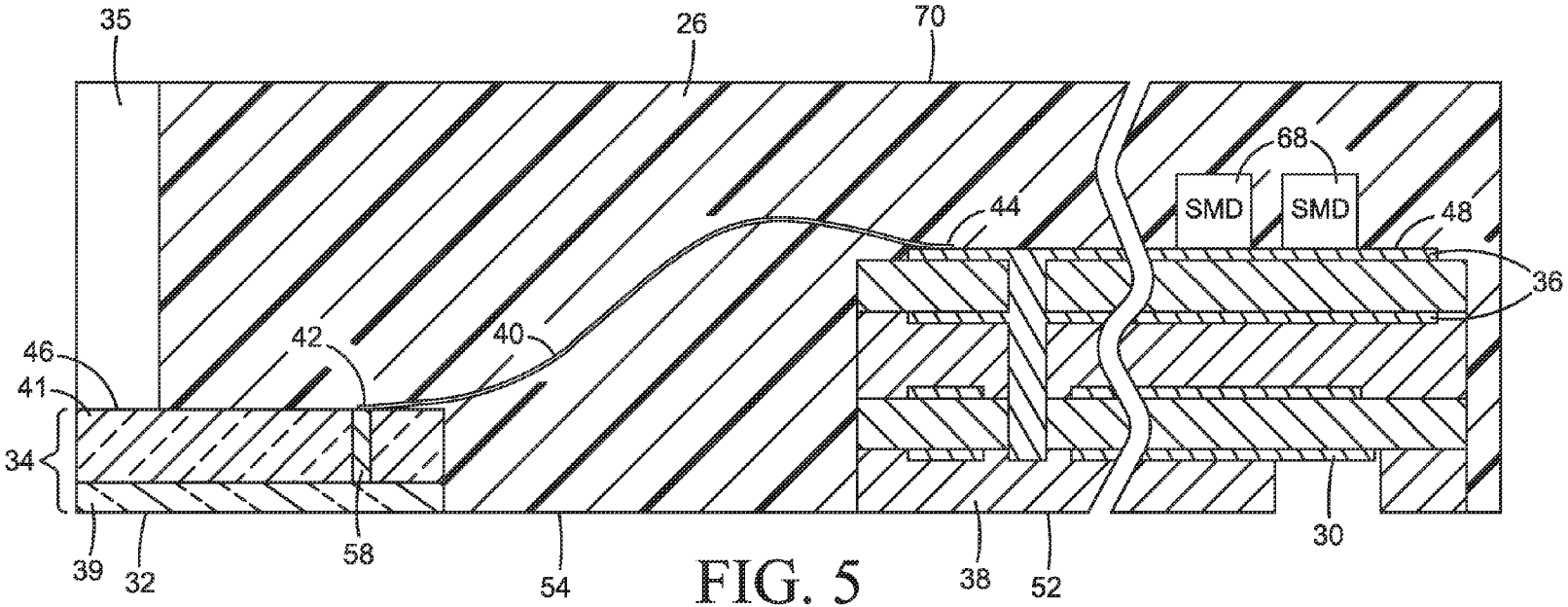
FIG. 5 is a section view taken along the line 5-5 in FIG. 2.
Figure 6:
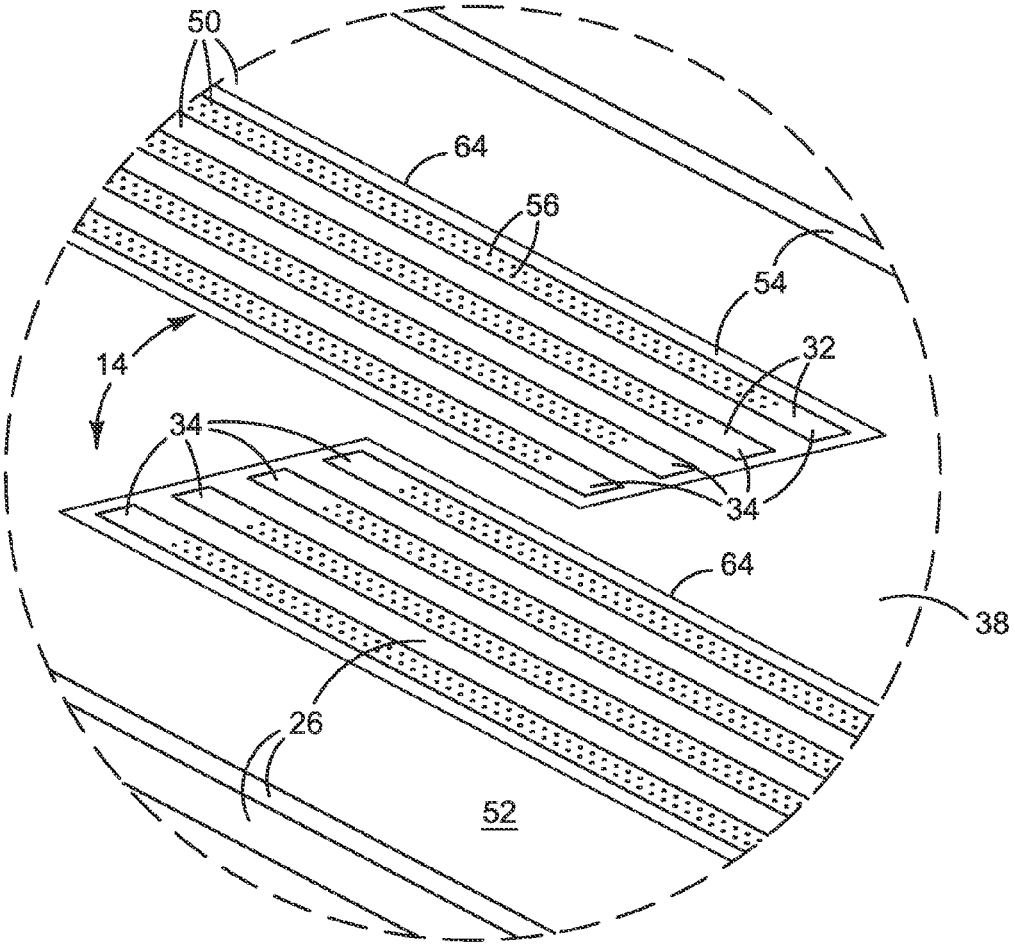
FIG. 6 is a detail view from FIG. 3.

FIGS. 2 and 3 are back-side and front-side perspective views, respectively, illustrating one example of a molded print bar 12 with multiple printheads 14 such as might be used in printer 10 shown in FIG. 1. FIGS. 4 and 5 are section views taken along the lines 4-4 and 5-5 in FIG. 2. FIG. 6 is a detail from FIG. 3. Referring to FIGS. 2-6, print bar 12 includes multiple printheads 14 embedded in a monolithic molding 26 and arranged in a row lengthwise across the print bar in a staggered configuration in which each printhead overlaps an adjacent printhead. Although ten printheads 14 are shown in a staggered configuration, more or fewer printheads 14 may be used and/or in a different configuration. Examples are not limited to a media wide print print bar. Examples could also be implemented in a scanning type inkjet pen or printhead assembly with fewer molded printheads, or even a single molded printhead.

Each printhead 14 includes printhead dies 34 embedded in molding 26 and channels 35 formed in molding 26 to carry printing fluid directly to corresponding printhead dies 34. Although four dies 34 arranged parallel to one another laterally across molding 26 are shown, for printing four different ink colors for example, more or fewer printhead dies 34 and/or in other configurations are possible. As noted above, the development of the new, molded inkjet printheads has enabled the use of tiny printhead die "slivers" such as those described in international patent application no. PCT/US2013/046065, filed Jun. 17, 2003 and titled Printhead Die. The molded printhead structures and electrical interconnections described herein are particularly well suited to the implementation of such tiny die slivers 34 in printheads 14.

In the example shown, the electrical conductors 36 that connect each printhead die 34 to external circuits are routed through a printed circuit board (PCB) 38. A printed circuit board is also commonly referred to as a printed circuit assembly (a "PCA"). An inkjet printhead die 34 is a typically complex integrated circuit (IC) structure 39 formed on a silicon substrate 41. Conductors 36 in PCB 38 carry electrical signals to ejector and/or other elements of each printhead die 34. As shown in FIG. 5, PCB conductors 36 are connected to circuitry in each printhead die 34 through bond wires 40. Although only a single bond wire 40 is visible in the section view of FIG. 5, multiple bond wires 40 connect each printhead die 34 to multiple PCB conductors 36.

Each bond wire 40 is connected to bond pads or other suitable terminals 42, 44 at the back part 46, 48 of printhead dies 34 and PCB 38, respectively, and then buried in molding 26. (Bond wires 40 and bond pads 42, 44 are also shown in the fabrication sequence views of FIGS. 8 and 9.) Molding 26 fully encapsulates bond pads 42, 44 and bond wires 40. "Back" part in this context means away from the front face 50 of print bar 12 so that the electrical connections can be fully encapsulated in molding 26. This configuration allows the front faces 32, 52, 54 of dies 34, molding 26, and PCB 38, respectively, to form a single uninterrupted planar surface/face 50 along ink ejection orifices 56 at the face 32 of each die 34, as best seen in the section view of FIG. 4.

Although other conductor routing configurations are possible, a printed circuit board provides a relatively inexpensive and highly adaptable platform for conductor routing in molded printheads. Similarly, while other configurations may be used to connect the printhead dies to the PCB conductors, bond wire assembly tooling is readily available and easily adapted to the fabrication of printheads 14 and print bar 12. For printhead dies 34 in which the internal electronic circuitry is formed primarily away from the back of the dies, through-silicon vias (TSV) 58 are formed in each die 34 to connect bond pads 42 at the back of the die 34 to the internal circuitry, as shown in FIG. 5. TSVs are not needed for die configurations that have internal circuitry already at the back of the die.

Figure 7:
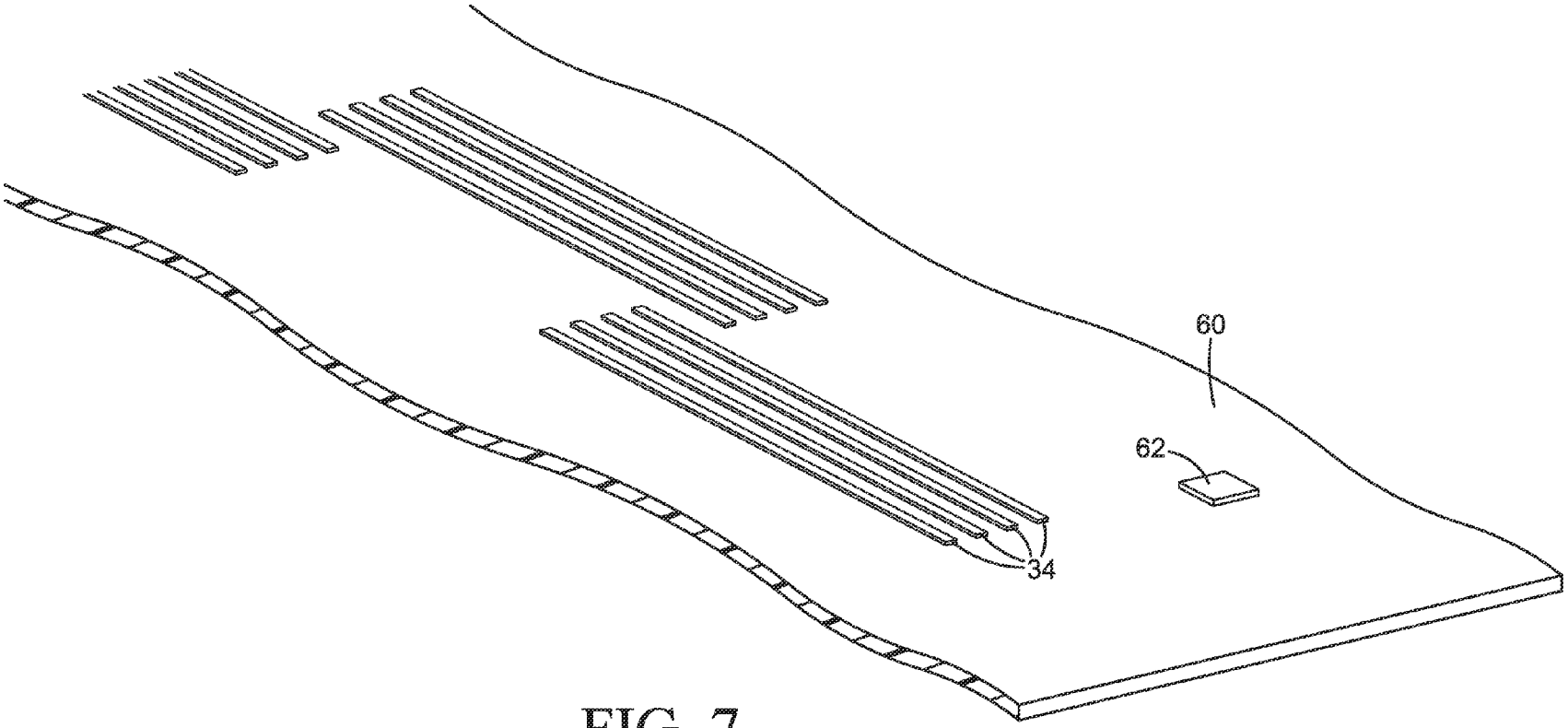
FIGS. 7-11 illustrate one example process for making a print bar such as the print bar shown in FIGS. 2-6.
Figure 8:
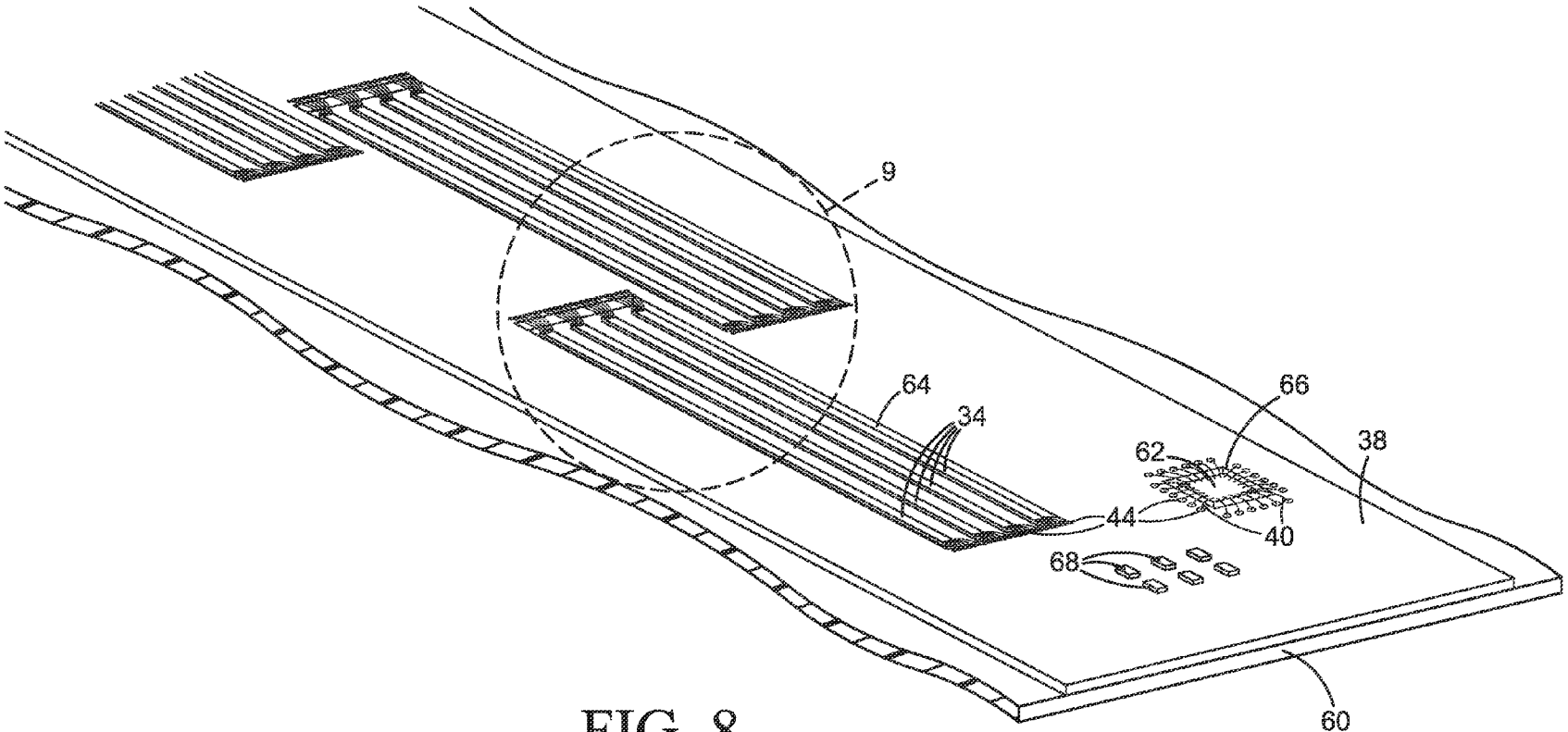
Figure 9:
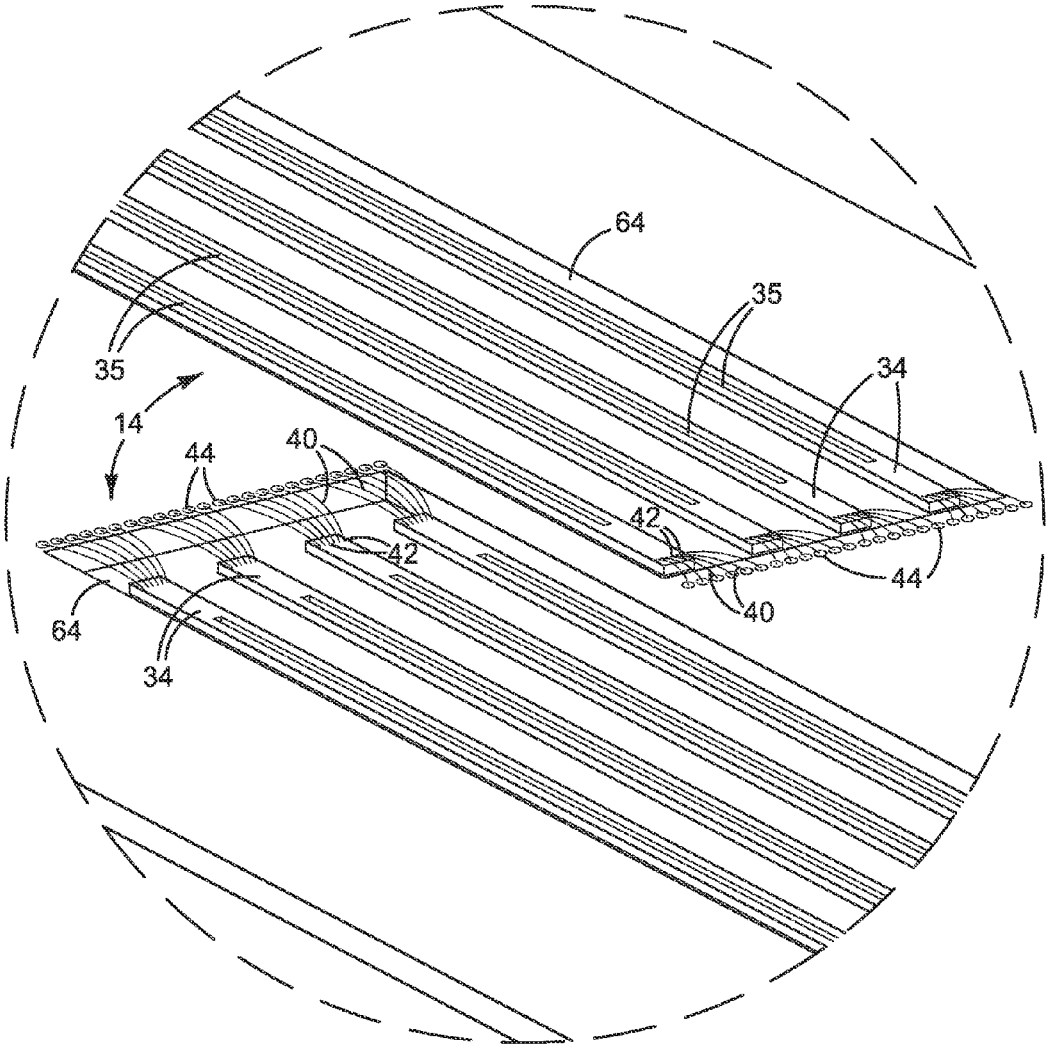
Figure 11:
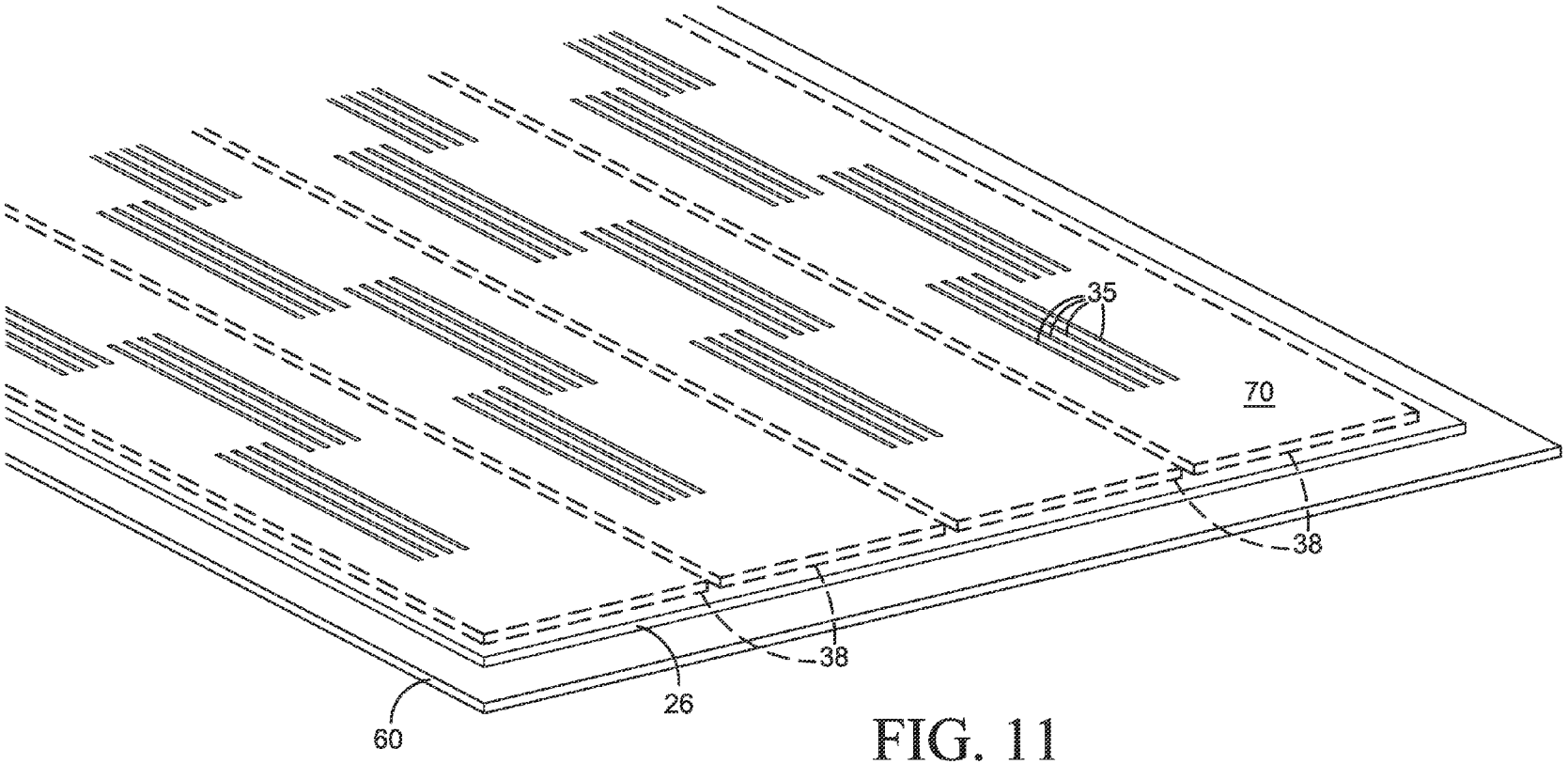
Figure 12:
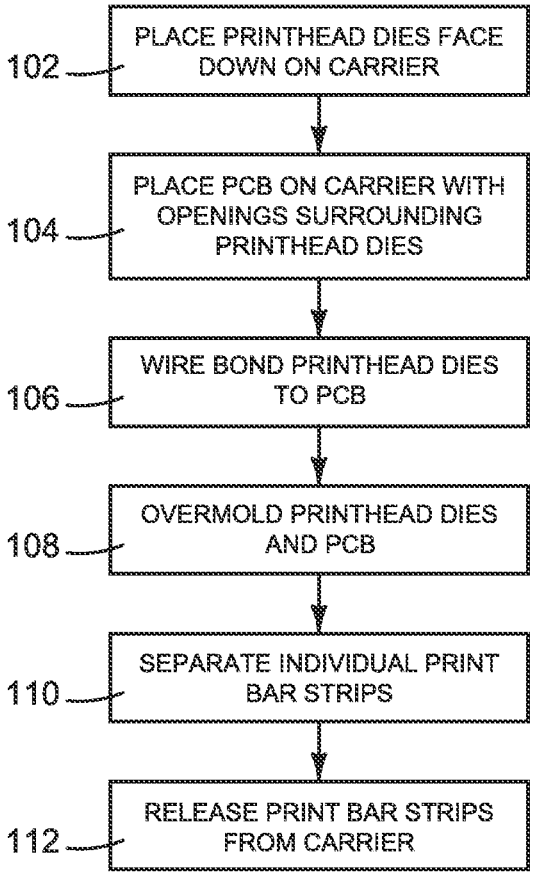
FIG. 12 is a flow diagram of the process illustrated in FIGS. 7-11.

One example process for making a print bar 12 will now be described with reference to FIGS. 7-11. FIG. 12 is a flow diagram of the process illustrated in FIGS. 7-11. Referring first to FIG. 7, printhead dies 34 are placed on a carrier 60 with a thermal tape or other suitable releasable adhesive (step 102 in FIG. 12). In the example shown, an application specific integrated circuit (ASIC) chip 62 is also placed on carrier 60. Then, as shown in FIGS. 8 and 9, PCB 38 is placed on carrier 60 with openings 64 surrounding printhead dies 34 and opening 66 surrounding ASIC 62 (step 104 in FIG. 12). Conductors in PCB 38 are then wire bonded or otherwise electrically connected to dies 34 and ASIC 62 (step 106 in FIG. 12). Surface mounted devices (SMDs) 68 may be included with PCB 38 as necessary or desirable for each print bar 12. One of the advantages of a molded print bar 12 with PCB conductor routing is the ease with which other components, such as ASIC 62 and SMDs 68, may be incorporated into the print bar.

Figure 10:
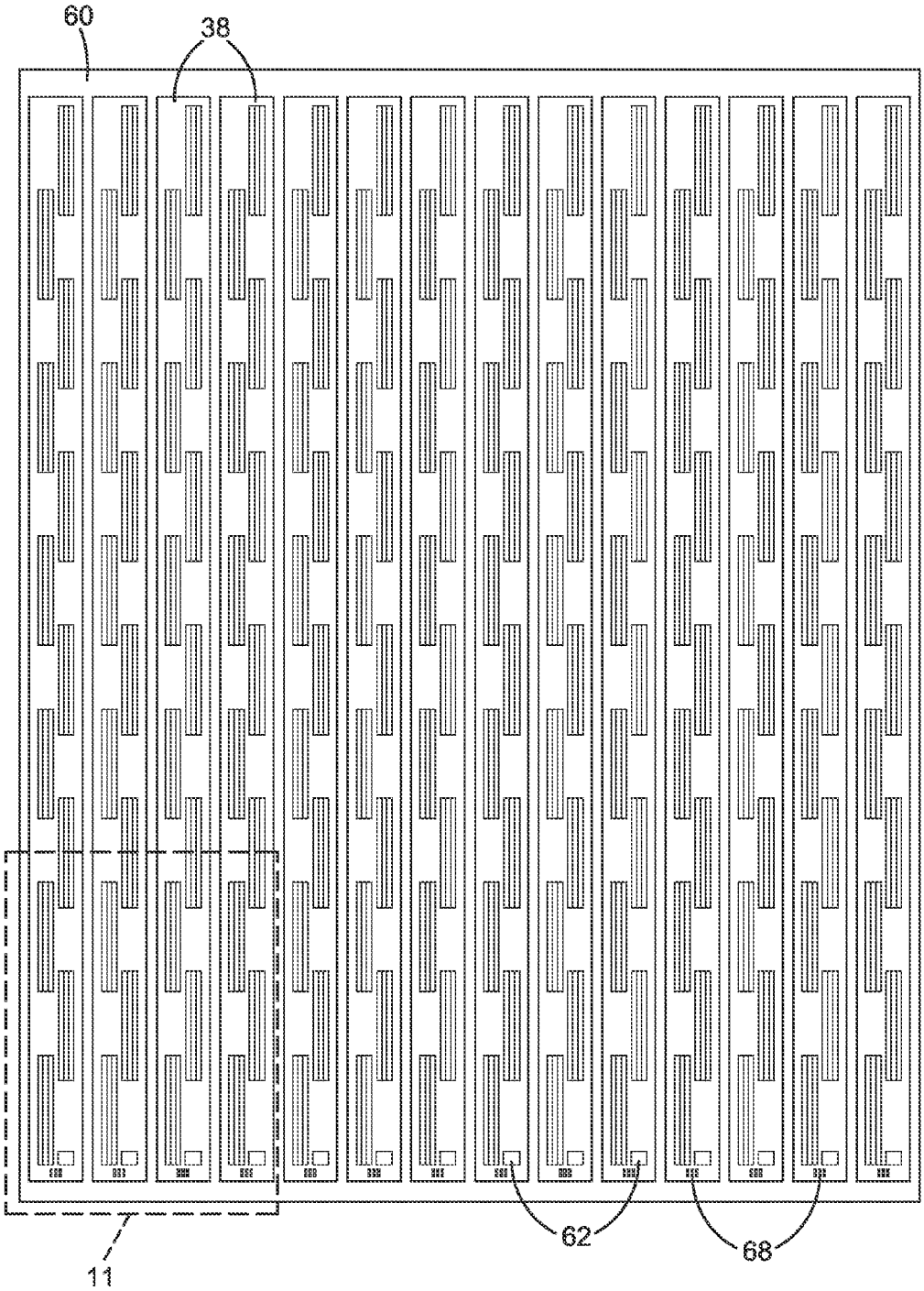

FIG. 10 is a plan view showing the lay-out of multiple in-process print bars from FIG. 8 on a carrier panel 60. PCBs 38 and printhead dies 34 on panel 60 are overmolded with an epoxy mold compound or other suitable moldable material 26 (step 108 in FIG. 12), as shown in FIG. 11, and then individual print bar strips are separated (step 110 in FIG. 12) and released from carrier 60 (step 112 in FIG. 12) to form individual print bars 12 shown in FIGS. 2-6. The molded structure may be separated into strips and the strips released from carrier 60 or the molded structure may be released from carrier 60 and then separated into strips. Any suitable molding technique may be used including, for example, transfer molding and compression molding. Channels 35 in molding 26 formed during overmolding may extend through to expose printhead dies 34. Alternatively, channels 35 formed during overmolding may extend only partially through molding 26 and powder blasted or otherwise opened to expose printhead dies 34 in a separate processing step.

Overmolding printhead dies 34 and PCB 38 placed face-down on carrier 60 produces a continuous planar surface across the front face 50 of each print bar 12 where ejection orifices 56 are exposed to dispense printing fluid. As best seen in FIG. 6, print bar face 50 is a composite of die faces 32, PCB face 52 and the face 54 of molding 26 surrounding dies 34 and PCB 38. If necessary or desirable to the particular implementation of print bar 12, the rear face 70 of molding 26 may be molded flat as well to make a completely flat print bar 12 (except at channels 35, of course). The use of a single adhesive, molding 26, to both hold the printhead dies 34 apart and encapsulate the electrical connections not only simplifies the printhead structure but also helps reduce material costs as well as fabrication process costs. In addition, an electrical RDL (redistribution layer) is unnecessary, an inexpensive PCB 38 performs the RDL function, and only a single level of electrical interconnect is used to connect each die 34 to PCB 38, to further simplify the structure and reduce fabrication costs.

"A" and "an" as used in the Claims means one or more.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A printhead, comprising:

a printhead die having a front face along which fluid may be dispensed from the die, the die molded into a monolithic molding having a channel therein through which fluid may pass directly to a back part of the die, the front face of the die exposed outside the molding and the back part of the die covered by the molding except at the channel;

an electrical contact exposed outside the molding to connect to circuitry external to the printhead;

a printed circuit board molded into the molding, the printed circuit board having an exposed front face co-planar with and surrounding the exposed front face of the die and a conductor electrically connected to the contact; and an electrical connection between the die and the printed circuit board conductor.

2. The printhead of claim 1, wherein the exposed front face of the die, the exposed front face of the printed circuit board, and a front face of the molding together form a continuous planar surface defining a front face of the printhead.

3. The printhead of claim 2, wherein the electrical connection is between the back part of the die and the printed circuit board conductor and fully encapsulated in the molding.

4. The printhead of claim 3, wherein:

the die includes a through-silicon-via from the back part of the die to circuitry internal to the die; and the electrical connection comprises a wire bond fully encapsulated in the molding from the through-silicon-via to the printed circuit board conductor.

5. The printhead of claim 4, wherein a back face of the molding opposite the front face forms a continuous planar surface except at the channel.

6. The printhead of claim 5, wherein:

the printhead die comprises multiple printhead die slivers arranged parallel to one another laterally across the molding; and the channel comprises multiple channels each through which fluid may pass directly to a back part of a corresponding one of the die slivers.

7. A method of fabricating the printhead of claim 1, comprising:

placing multiple printhead dies face down on a carrier;

wire bonding each printhead die to the printed circuit board; and overmolding the printhead dies and the printed circuit board on the carrier, including fully encapsulating the wire bonds, to produce the monolithic molding.

8. The method of claim 7, wherein placing the printed circuit board on the carrier includes placing the printed circuit board on the carrier with each of multiple openings in the printed circuit board surrounding one or more of the printhead dies.

9. The method of claim 7, further comprising placing a non-printhead die electronic device on the carrier and wire bonding the non-printhead die electronic device to the printed circuit board, and wherein the overmolding includes overmolding the non-printhead die electronic device on the carrier.

10. The method of claim 7, further comprising:

separating the molded structure into individual print bars and then releasing the print bars from the carrier; or releasing the molded structure from the carrier and then separating the molded structure into individual print bars.

11. A printhead, comprising:

multiple printhead dies embedded in a molding with fully encapsulated electrical conductors that extend from each of the dies to an exposed electrical contact, the dies and the molding together defining an exposed planar surface surrounding dispensing orifices at a front face of each of the dies, and the molding having a channel therein through which fluid may pass to the dies; and a printed circuit board embedded in the molding, the conductors including first conductors in the printed circuit board connected to the contact, and second conductors connecting the first conductors to a back part of the dies, and the dies, the molding and the printed circuit board together forming the exposed planar surface surrounding the dispensing orifices at the front face of each of the dies.

12. The printhead of claim 11, wherein the second conductors comprise bond wires.

13. The printhead of claim 12, wherein:

each die includes a through-silicon-via from the back part of the die to circuitry internal to the die; and each bond wire connects a through-silicon-via to a first conductor.

14. The printhead of claim 12, further comprising a non-printhead die electronic device embedded in the molding and connected to a first conductor in the printed circuit board with bond wires fully encapsulated in the molding.

15. A printhead, comprising:

an elongated cuboidal printhead die sliver in a monolithic molding covering a back and sides of the die sliver leaving a front of the die sliver exposed along a planar surface that includes a front face of the die sliver and a front face of the molding surrounding the front face of the die sliver, the molding having an opening therein through which fluid may pass directly to a back part of the die sliver; and a printed circuit board in the molding, the molding covering a back and sides of the printed circuit board leaving a front face of the printed circuit board exposed along the planar surface that includes the front face of the die sliver, the front face of the molding surrounding the front face of the die sliver, and the front face of the printed circuit board, the printed circuit board having conductors therein electrically connected to a back part of the die sliver covered by the molding.

16. The printhead of claim 15, wherein:

the elongated cuboidal printhead die sliver comprises multiple elongated cuboidal die slivers arranged generally end to end along the molding in a staggered configuration in which one or more of the die slivers overlap an adjacent one or more of the die slivers; and the opening comprises multiple openings each positioned at a back part of a corresponding one of the die slivers.

17. The printhead of claim 15, wherein:

the elongated cuboidal printhead die sliver comprises multiple elongated cuboidal die slivers arranged parallel to one another laterally across the molding; and the opening comprises multiple openings each positioned at a back part of a corresponding one of the die slivers.

* * * * *